US009920531B1

(12) United States Patent
Charest et al.

(10) Patent No.: US 9,920,531 B1
(45) Date of Patent: Mar. 20, 2018

(54) POST AND BEAM SYSTEM

(71) Applicants: Peter J. Charest, North Port, FL (US); Laurie Sharp, Dunedin, FL (US)

(72) Inventors: Peter J. Charest, North Port, FL (US); Laurie Sharp, Dunedin, FL (US)

(73) Assignee: Connecticut Post & Beam LLC, Winchester Center, CT (US)

( * ) Notice: Subject to any disclaimer, the term of this patent is extended or adjusted under 35 U.S.C. 154(b) by 0 days.

(21) Appl. No.: 15/060,674

(22) Filed: Mar. 4, 2016

Related U.S. Application Data

(60) Provisional application No. 62/130,280, filed on Mar. 9, 2015.

(51) Int. Cl.

| | |
|---|---|
| ***E04C 3/12*** | (2006.01) |
| ***E04B 1/48*** | (2006.01) |
| ***B27B 17/00*** | (2006.01) |
| *E04B 1/38* | (2006.01) |

(52) U.S. Cl.
CPC ..... *E04C 3/12* (2013.01); *B27B 17/0083* (2013.01); *E04B 1/48* (2013.01); *E04B 2001/405* (2013.01)

(58) Field of Classification Search
CPC ... E04B 1/48; E04B 1/486; E04B 1/49; E04B 1/54; E04B 1/40; E04B 1/2604; E04C 3/12
USPC ..... 52/649.2, 650.1, 653.1, 655.1, 656.9; 403/232.1, 230, 294
See application file for complete search history.

(56) References Cited

U.S. PATENT DOCUMENTS 4,299,509 A * 11/1981 Meickl ..... E04B 1/2604 403/174
4,558,968 A * 12/1985 Meickl ..... E04B 1/2604 144/354
5,061,111 A * 10/1991 Hosokawa ..... E04B 1/2604 403/187
5,062,733 A * 11/1991 Cholid ..... E04B 1/2604 403/189

(Continued)

FOREIGN PATENT DOCUMENTS

FR 2647861 A1 * 12/1990 ..... E04B 1/2604
FR 2974605 A1 * 11/2012 ..... E04B 1/2604
WO WO 2010140277 A1 * 12/2010 ..... E04B 1/2604

OTHER PUBLICATIONS

Machine Translate of FR2647861A1.*

*Primary Examiner* — Babajide A Demuren
(74) *Attorney, Agent, or Firm* — Leydig, Voit & Mayer, Ltd.

(57) ABSTRACT

A beam has an upper face, a lower face, side faces, and an end face. The end face has a rectangular configuration and is vertically disposed. The end face has a slot vertically disposed and parallel with, and equally spaced from, the side faces. Beam holes extend through the beam on opposite sides of the slot. A post has a front face, a parallel rear face, and parallel side faces. A connector has a first section and a second section. Beam apertures are formed in the first section. The first section is positioned in the slot with the beam apertures aligned with the beam holes. The second section is attached to the post. Dowels extend through the beam holes and the beam apertures thereby coupling the beam to the post. The system also includes tools for accurately cutting and drilling components, wood and otherwise, to be coupled.

8 Claims, 12 Drawing Sheets

(56) References Cited

U.S. PATENT DOCUMENTS

| | | | | | |
|---|---|---|---|---|---|
| 5,242,239 | A * | 9/1993 | Hosokawa | E04B 1/2604 | 403/258 |
| 5,253,945 | A * | 10/1993 | Hosokawa | E04B 1/2604 | 403/258 |
| 5,342,138 | A * | 8/1994 | Saito | E04B 1/2604 | 403/187 |
| 5,577,856 | A * | 11/1996 | Tezuka | E04B 1/2604 | 403/294 |
| 5,938,366 | A * | 8/1999 | Novacek | E04B 1/2604 | 403/230 |
| 6,032,431 | A * | 3/2000 | Sugiyama | E04B 1/2604 | 403/230 |
| 6,669,396 | B2 * | 12/2003 | Mattle | E04B 1/2604 | 29/428 |
| 8,511,033 | B2 * | 8/2013 | Kumakawa | E04B 1/48 | 403/230 |
| 2007/0186503 | A1 * | 8/2007 | Homma | E04B 1/2604 | 52/655.1 |
| 2013/0227906 | A1 * | 9/2013 | Schold | E04B 1/26 | 52/650.1 |

* cited by examiner

FIG. 3
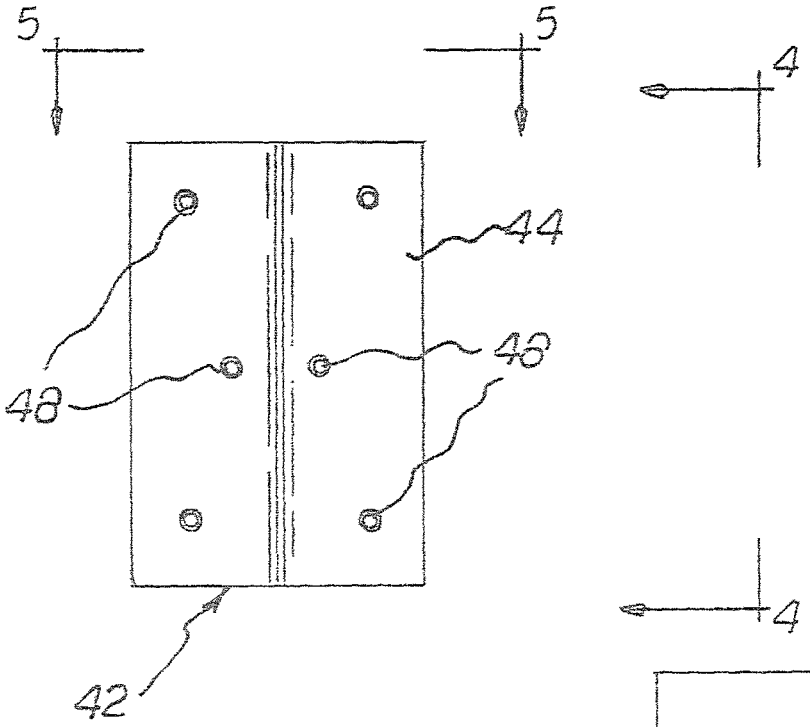
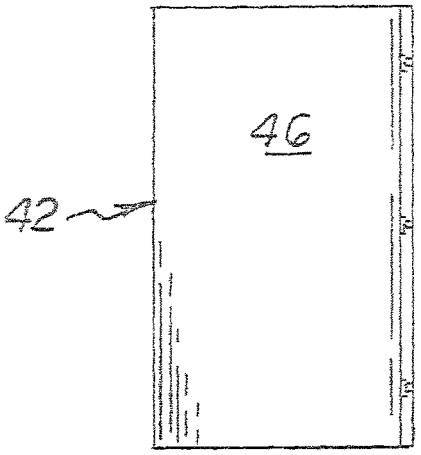
FIG. 4
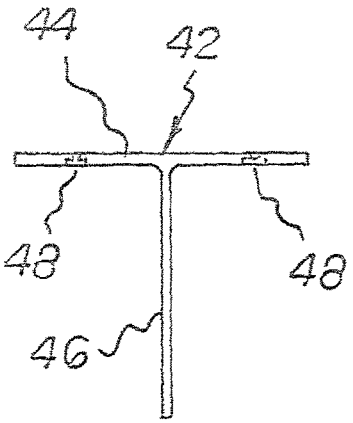
FIG. 5

FIG. 6
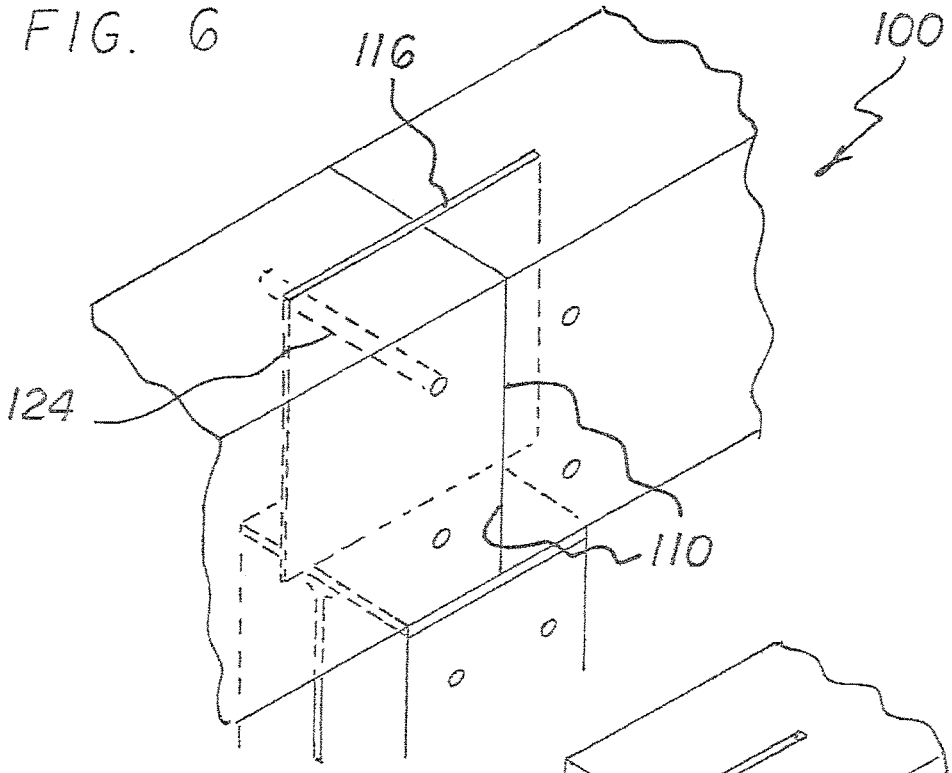
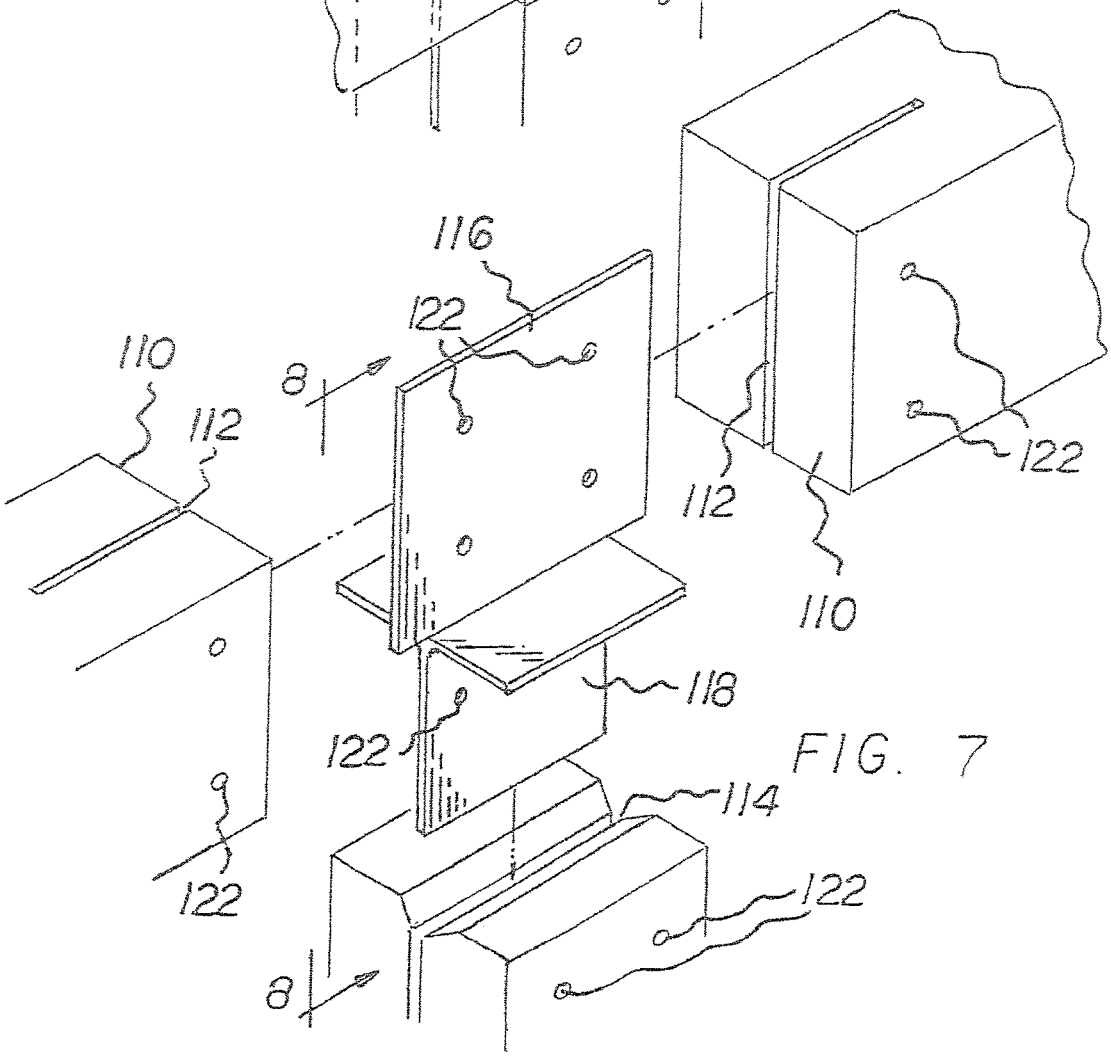
FIG. 7

FIG. 7A
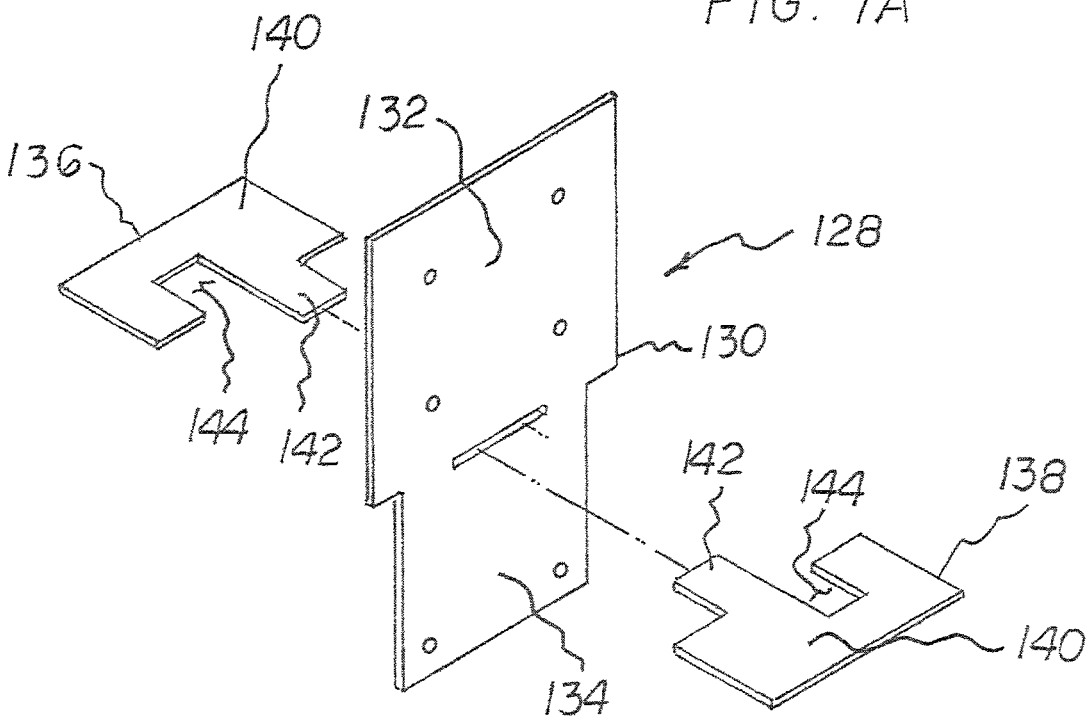
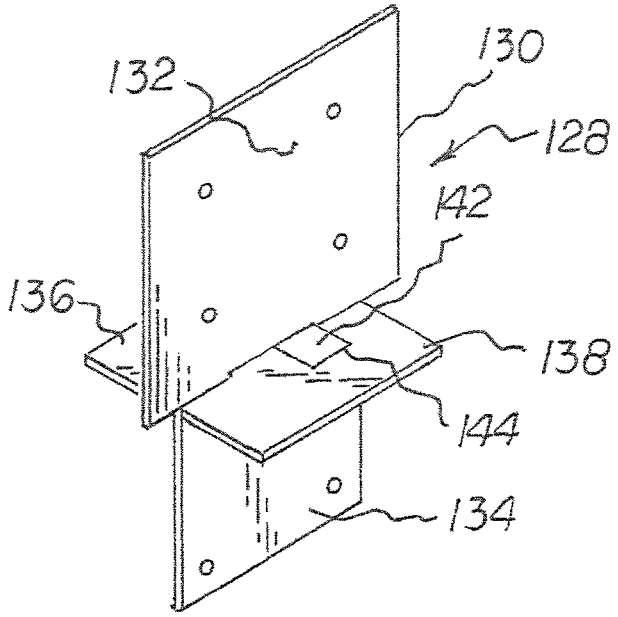
FIG. 7B

FIG. 11
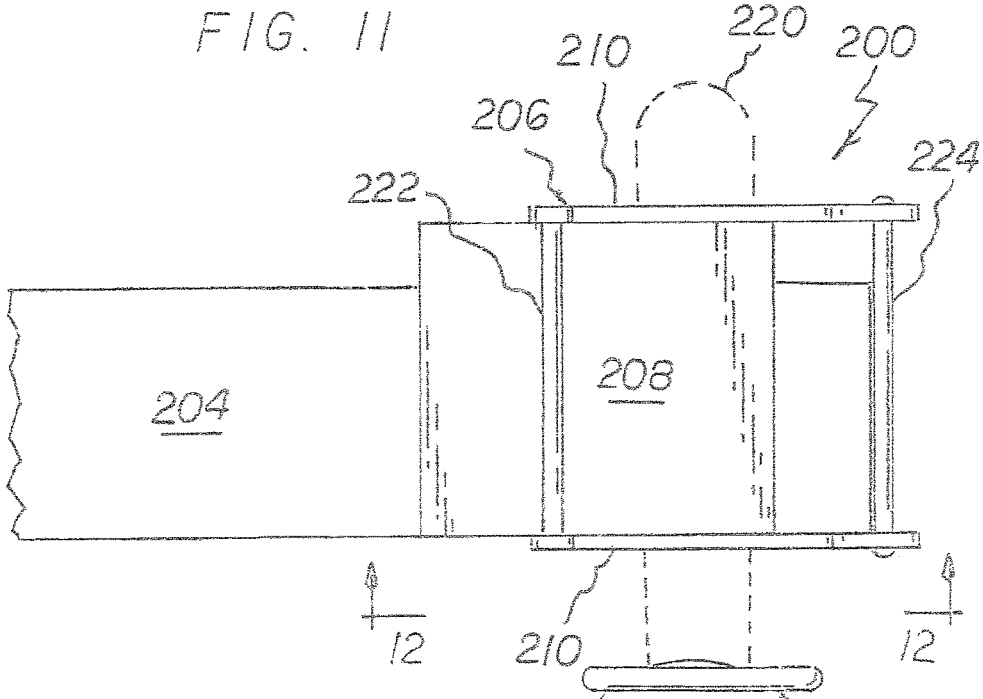
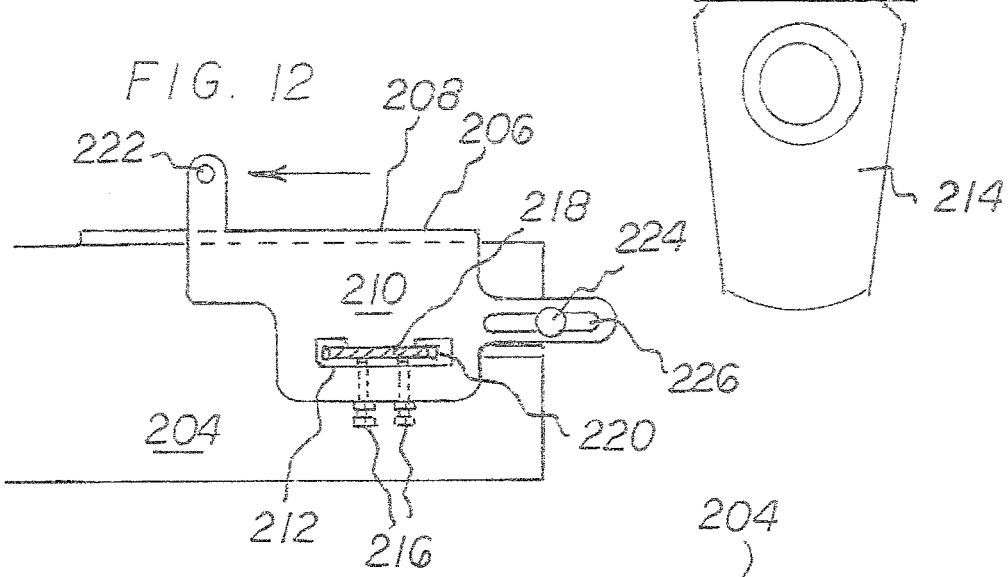
FIG. 12
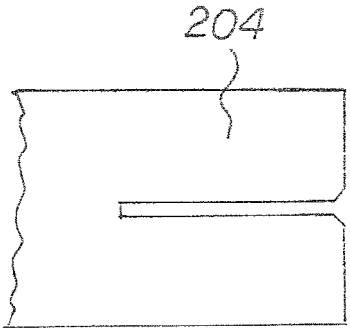
FIG 13

FIG. 18
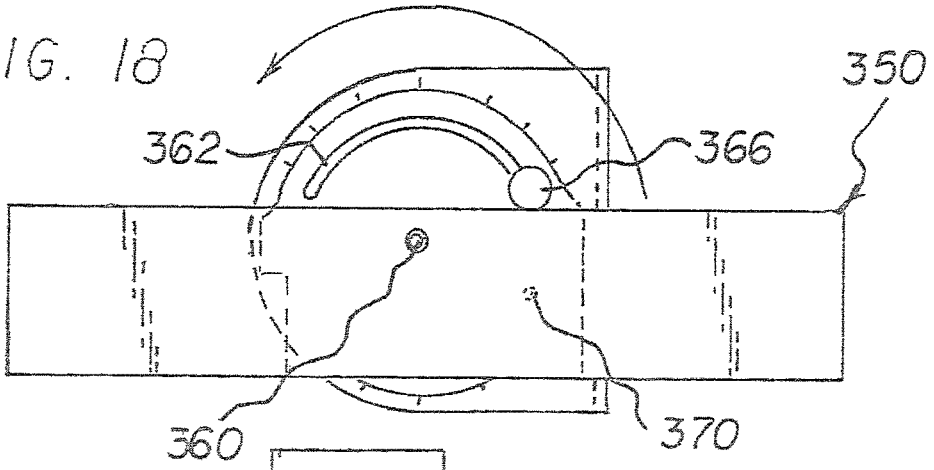
FIG. 19
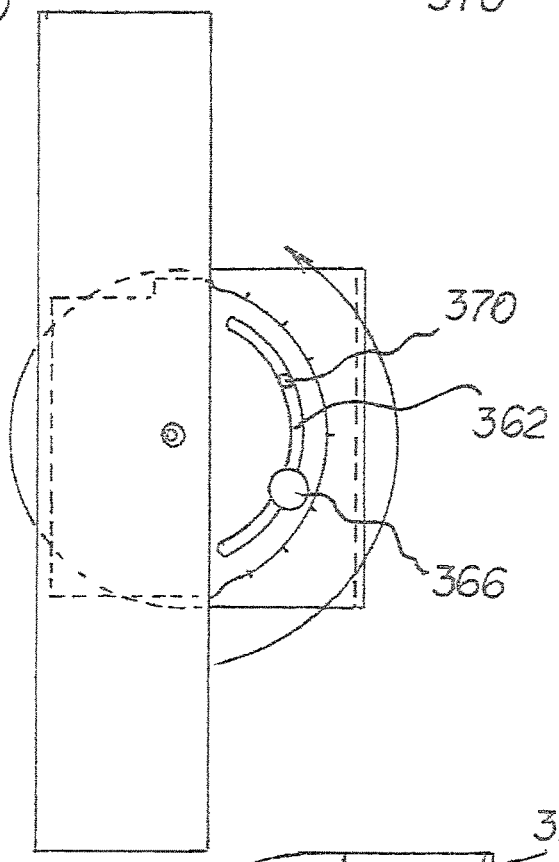
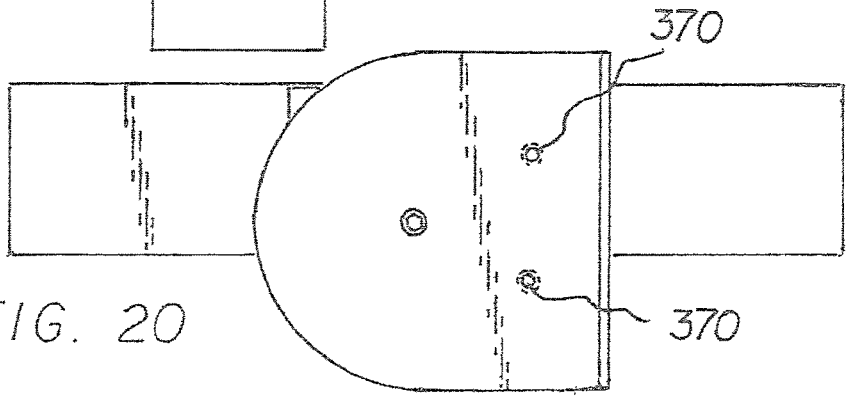
FIG. 20

FIG. 21
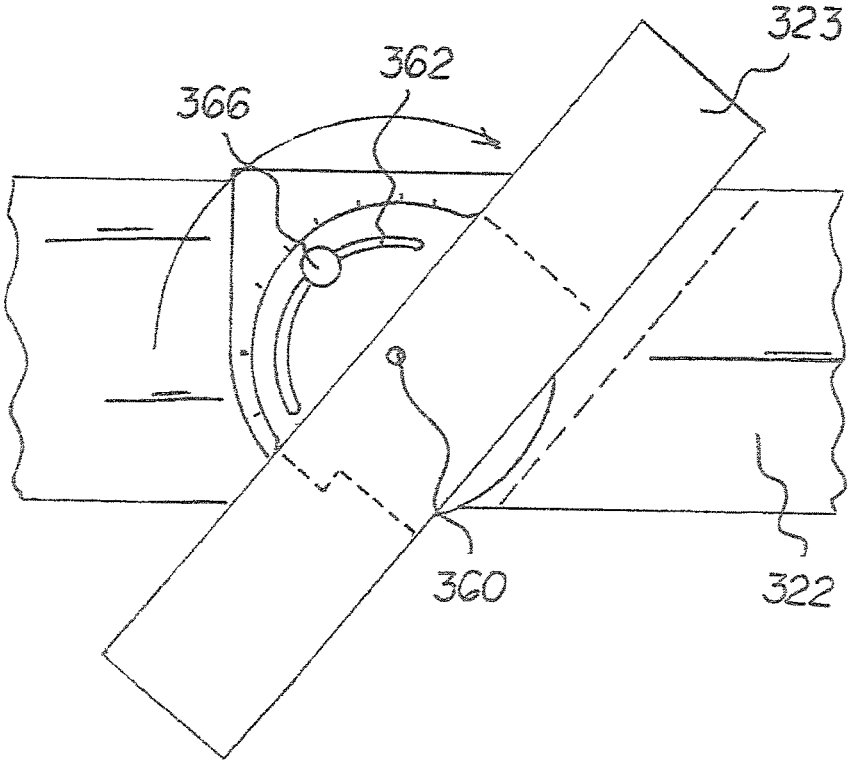
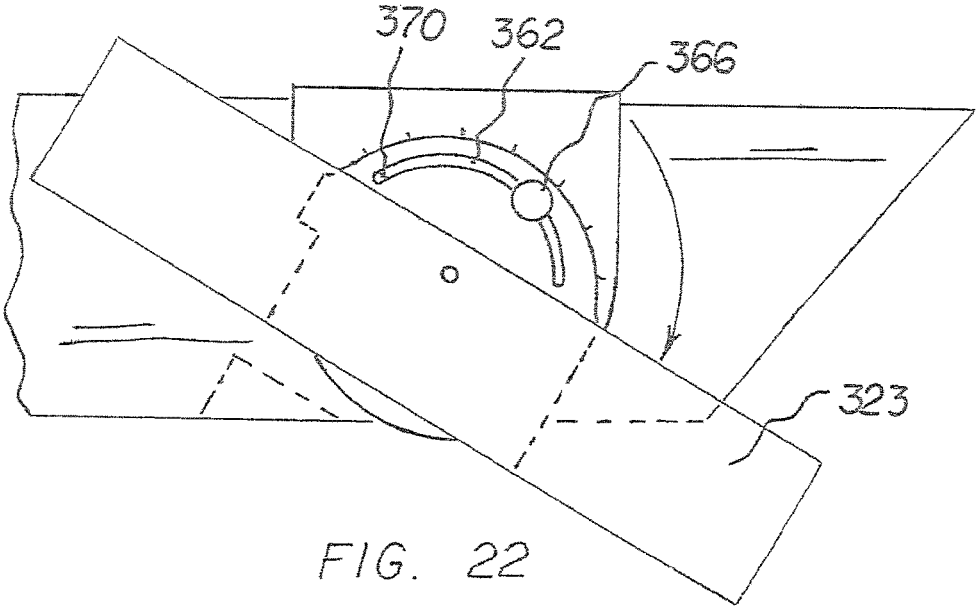
FIG. 22

POST AND BEAM SYSTEM

RELATED APPLICATION

The present application is based upon Provisional Application No. 62/130,280 filed Mar. 9, 2015, the subject matter of which is incorporated herein by reference.

BACKGROUND OF THE INVENTION

Field of the Invention

The present invention relates to a post and beam system and more particularly pertains to coupling a beam to a post and for preparing the post and the beam for coupling in a safe, rapid, accurate, eye-appealing, and economical manner.

Description of the Prior Art

The use of post and beam systems of known designs and configurations is known in the prior art. More specifically, post and beam systems of known designs and configurations previously devised and utilized for the purpose of constructing post and beam buildings are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, the prior art does not describe a post and beam system that allows coupling a beam to a post and for preparing the post and the beam for coupling in a safe, rapid, accurate, eye-appealing, and economical manner.

In this respect, the post and beam system according to the present invention substantially departs from the conventional concepts and designs of the prior art, and in doing so provides an apparatus primarily developed for the purpose of coupling a beam to a post and for preparing the post and the beam for coupling in a safe, rapid, accurate, eye-appealing, and economical manner.

Therefore, it can be appreciated that there exists a continuing need for a new and improved post and beam system which can be used for coupling a beam to a post and for preparing the post and the beam for coupling in a safe, rapid, accurate, eye-appealing, and economical manner. In this regard, the present invention substantially fulfills this need.

SUMMARY OF THE INVENTION

In view of the disadvantages inherent in the known types of post and beam constructions now present in the prior art, the present invention provides an improved post and beam system. As such, the general purpose of the present invention, which will be described subsequently in greater detail, is to provide a new and improved post and beam system and method which has all the advantages of the prior art and none of the disadvantages.

To attain this, the present invention essentially comprises a beam having an upper face, a lower face, side faces, and an end face. The end face has a rectangular configuration and is vertically disposed. The end face has a slot vertically disposed and parallel with, and equally spaced from, the side faces. Beam holes extend through the beam on opposite sides of the slot. Next provided is a post having a front face, a parallel rear face, and parallel side faces. A connector is provided having a first section and a second section. Beam apertures are formed in the first section. The first section is positioned in the slot with the beam apertures aligned with the beam holes. The second section is attached to the post. Lastly, dowels are provided extending through the beam holes and the beam apertures thereby coupling the beam to the post.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved post and beam system which has all of the advantages of the prior art post and beam constructions and none of the disadvantages.

It is another object of the present invention to provide a new and improved post and beam system which may be easily and efficiently manufactured and marketed.

It is further object of the present invention to provide a new and improved post and beam system which is of durable and reliable constructions.

An even further object of the present invention is to provide a new and improved post and beam system which is susceptible of a low cost of manufacture with regard to both materials and labor, and which accordingly is then susceptible of low prices of sale, thereby making such post and beam system economically available.

Lastly, it is an object of the present invention to provide a new and improved post and beam system which can be used for coupling a beam to a post and for preparing the post and the beam for coupling in a safe, rapid, accurate, eye-appealing, and economical manner. In this regard, the present invention substantially fulfills this need.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view of the connector taken along line 3-3 of FIG. 2.

FIG. 4 is a side elevational view of the connector taken along line 4-4 of FIG. 3.

FIG. 5 is a plan view of the connector taken along line 5-5 of FIG. 3.

FIG. 6 is a perspective illustration of an alternate embodiment of the invention.

FIG. 7 an exploded perspective illustration of the alternate embodiment of the invention shown in FIG. 6.

FIG. 7A is an exploded perspective illustration of a connector constructed in an alternate design.

FIG. 7B is a perspective illustration of the connector illustrated in FIG. 7A.

FIG. 11 is a plan view of a slotting device constructed in accordance with the principles of the present invention.

FIG. 12 is a front elevational view taken along line 12-12 of FIG. 11.

FIG. 13 is a front elevational view taken along line 13-13 of FIG. 2.

FIG. 18 is a plan view taken along line 18-18 of FIG. 17.

FIG. 19 is a plan view similar to FIG. 18 but with the device rotated for an angled cut.

FIG. 20 is a bottom view taken along line 20-20 of FIG. 17.

FIG. 21 is a plan view similar to FIG. 18 but with the device rotated for an angled cut.

FIG. 22 is a plan view similar to FIG. 21 but with the device rotated for a notch cut.

The same reference numerals refer to the same parts throughout the various Figures.

DESCRIPTION OF THE PREFERRED EMBODIMENT

Figure 1:
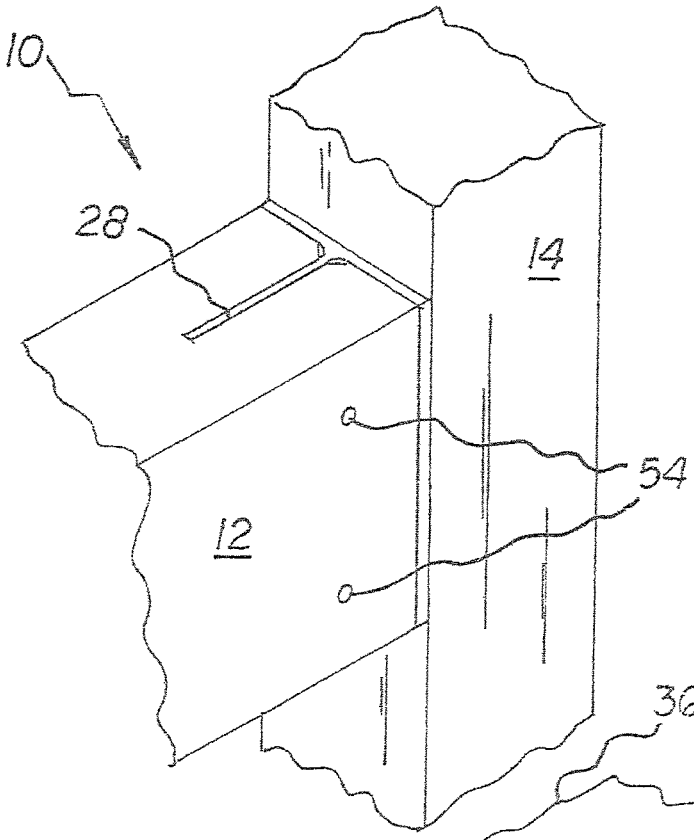
FIG. 1 is a perspective illustration of a post and beam system constructed in accordance with the principles of the present invention.
Figure 2:
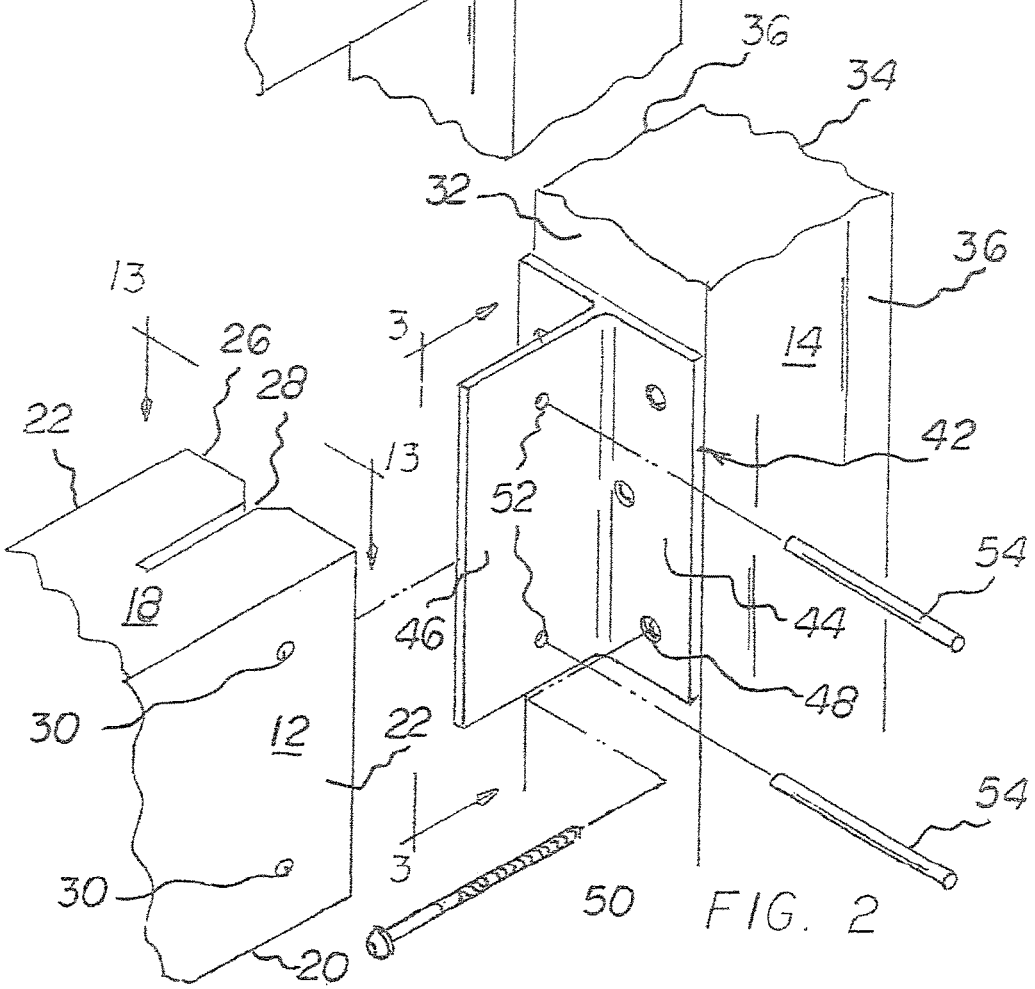
FIG. 2 is an exploded perspective illustration of the system shown in FIG. 1.
Figure 8:
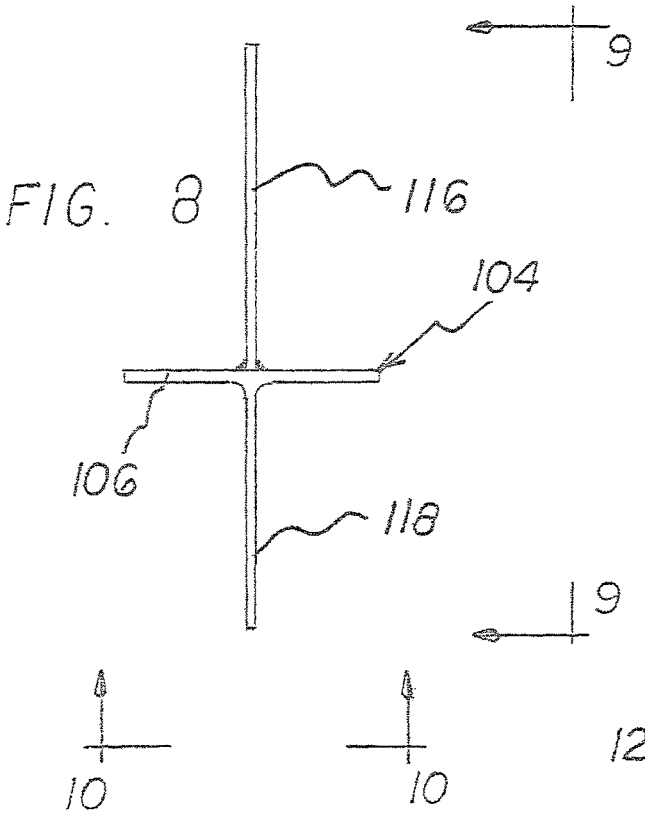
FIG. 8 is a front elevational view of the connector taken along line 8-8 of FIG. 7.
Figure 9:
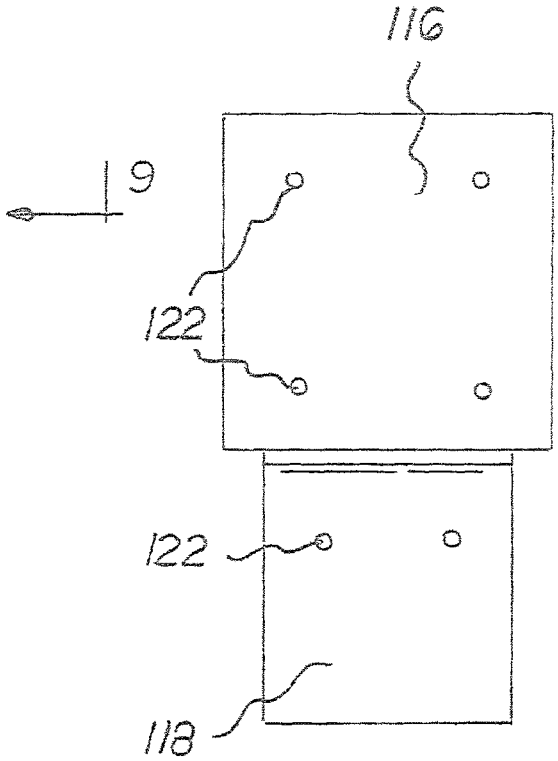
FIG. 9 is a side elevational view of the connector taken along line 9-9 of FIG. 8.
Figure 10:
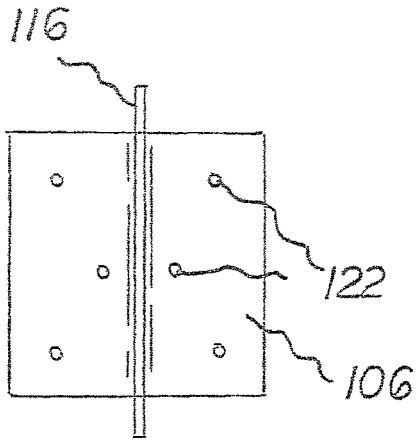
FIG. 10 is a bottom view of the connector taken along line 10-10 of FIG. 8.

With reference now to the drawings, and in particular to FIG. 1 thereof, the preferred embodiment of the new and improved post and beam system embodying the principles and concepts of the present invention and generally designated by the reference numeral 10 will be described.

The present invention, the post and beam system 10 is comprised of a plurality of components. Such components are individually configured and correlated with respect to each other so as to attain the desired objective. In their broadest context such include a beam, a post, a connector and dowels. In this broad context, first provided is a beam having an upper face, a lower face, side faces, and an end face. The end face has a rectangular configuration and is vertically disposed. The end face has a slot vertically disposed and parallel with, and equally spaced from, the side faces. Beam holes extend through the beam on opposite sides of the slot. Next provided is a post having a front face, a parallel rear face, and parallel side faces. A connector is provided having a first section and a second section. Beam apertures are formed in the first section. The first section is positioned in the slot with the beam apertures aligned with the beam holes. The second section is attached to the post. Lastly, dowels are provided extending through the beam holes and the beam apertures thereby coupling the beam to the post. Such components are individually configured and correlated with respect to each other so as to attain the desired objective.

In the preferred embodiment, the post and beam system 10 is designed for coupling a beam 12 to a post 14 and for preparing the post and the beam for coupling. The coupling and the preparing are done in a safe, rapid, accurate, eye-appealing, and economical manner, first provided is a beam 12. The beam has a rectangular cross sectional configuration with four elongated faces 18, 20, 22 and an end face 26. The four elongated faces include a horizontally disposed upper face 18, a parallel lower face 20, and parallel vertically disposed side faces 22. The end face 26 has a rectangular configuration and is vertically disposed. A vertically disposed slot 28 is formed in the end face parallel with, and equally spaced from the side faces. The slot has tapered edges. The tapered edges are optional. Beam holes 30 extend through the beam on opposite sides of the slot.

Next provided is a post 14. The post has a rectangular cross sectional configuration with four elongated faces 32, 34, 36, and an end face. Each of the four elongated faces is vertically disposed. The four elongated faces include a front face 32 and a parallel rear face 34. The four elongated faces also include parallel side faces 36. The end face is vertically disposed and has a rectangular configuration. The post and the beam are fabricated of wood and/or engineered wood.

Lastly, a connector 42 is provided. The connector has a T-shaped cross sectional configuration and includes a vertically disposed rectangular cross component 44 and a vertically disposed rectangular central component 46. The central component is attached to the cross component at a central extent of the cross component. Screw holes 48 are formed in the cross component on opposite sides of the central component. Screws 50 extend through the screw holes and into the front face 32 of the post. The central component is positioned in the slot with beam apertures 52 aligned with the beam holes. Dowels 54 extend through the beam holes and the beam apertures thereby coupling the beam to the post. One or more of the coupled components, post and/or beam, is preferably fabricated of wood. Alternatively, one component, such as a floor may be fabricated of concrete, in which case the connector would be attached through threaded fasteners.

In an alternate embodiment 100 of the system, the connector has a cross-shaped cross sectional configuration and includes a vertical component 104 and a horizontal component 106. The beam in this embodiment is two similarly configured beams with end faces 110 in face-to-face contact. Beam slots 112 are formed in the end faces of the beams aligned in a vertical plane. The post has a post slot 114 in the end face of the post. The vertical component of the connector has an upper section 116 positioned in the beam slots. The vertical component of the connector has a lower section 118 located in the post slot. Holes 122 extend through the beams and the post and the connector. Dowels 124 extend through the holes. The horizontal component of the connector is located between the beams above and the post below.

FIGS. 7A and 7B illustrate a connector 128 of an alternate construction. Such connector includes a vertical component 130 with a rectangular upper region 132 and a rectangular lower region 134. A horizontal slot divides the upper and lower regions. Such connector includes a first horizontal component 136 and a second horizontal component 138. The first and second components are similarly configured with laterally exterior regions 140 in a rectangular configuration. The first and second components are each formed with a rectangular projection 142 and a rectangular recess 144. The rectangular projections pass through the horizontal slot and are received in the rectangular recesses thereby forming a component in a cross-shaped configuration, preferably weld free. The various connectors are preferably fabricated of aluminum.

In an alternate embodiment of the invention, a slotting device 200 is included for use with a chainsaw to cut and a workpiece to be cut. The term workpiece is intended to include posts and beams. The chainsaw is of the type having a motor housing portion. A substantially planar guide bar portion rigidly projects from the motor housing portion. A cutting chain portion surrounds a perimeter of the guide bar portion.

The workpiece is first horizontally positioned at a work station. Positioned over the workpiece is a slotting device 206 formed of an upper plate 208 and two similarly configured side plates 210. The upper plate is horizontally positioned for sliding along an upper surface of the workpiece. The side plates are vertically oriented, extending downwardly from the upper plate, parallel with sides of the workpiece. Slits 212 are formed in the side plates. The slits receive a chain saw 214 with bolts 216 securing a central cutting guide 218 of the chain saw while allowing movement of a cutting chain 220 while cutting. A handle post 222 is secured above the upper plate in a forward region of the chain saw. A bottoming post 224 is positioned rearwardly of the chain saw to limit horizontal movement of the chain saw and the slotting device with respect to the workpiece. Each side wall has a rearward extension 226 with a horizontally extending opening to allow laterally positioning and securement of the bottoming post as a function of the desired depth of the slot.

Figure 12A:
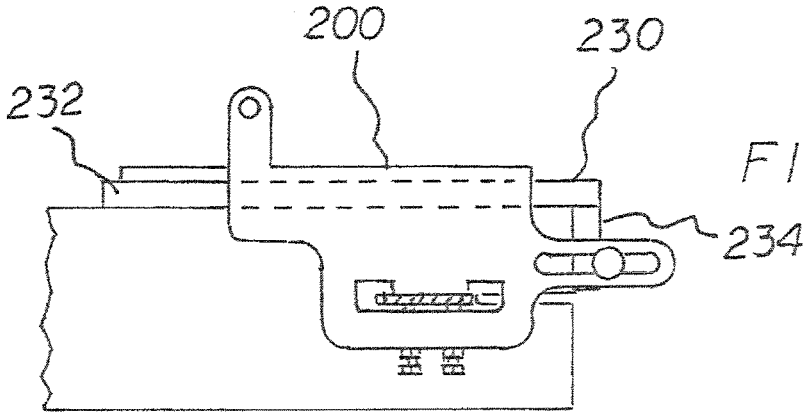
FIG. 12A is a side elevational view of a slotting device with an adapter for use with smaller workpieces.
Figure 12B:
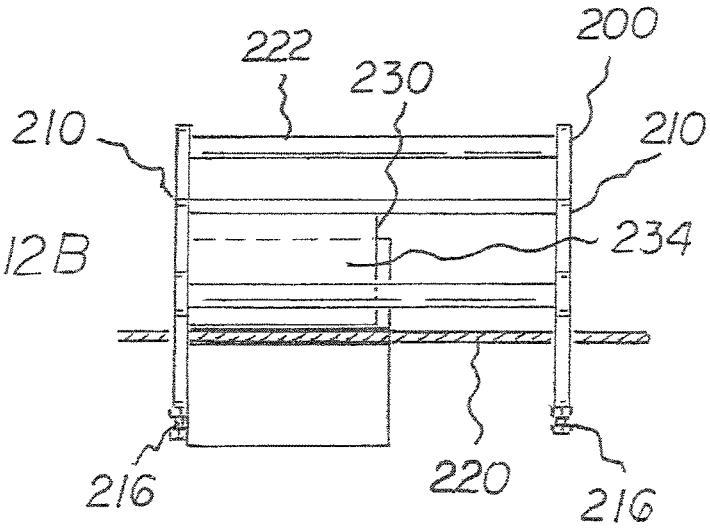
FIG. 12B is a front elevational view of the slotting device and adapter of FIG. 12A.
Figure 12C:
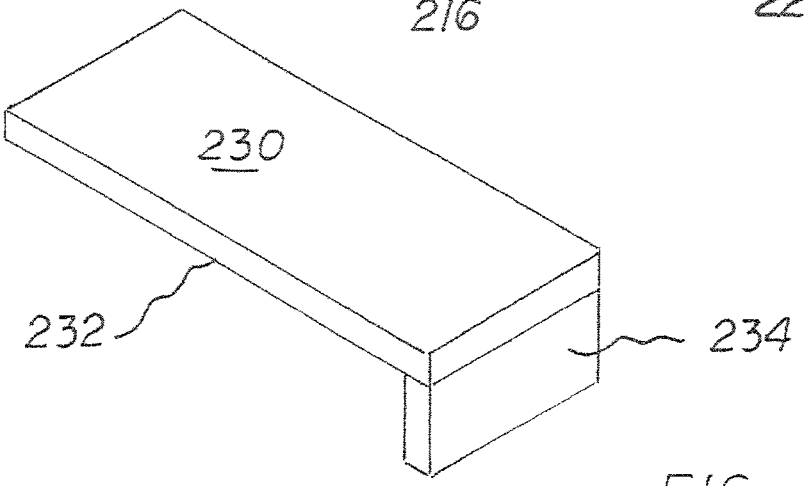
FIG. 12C is a perspective view of the adapter without the slotting device and workpiece of FIGS. 12A and 12B.
Figure 14:
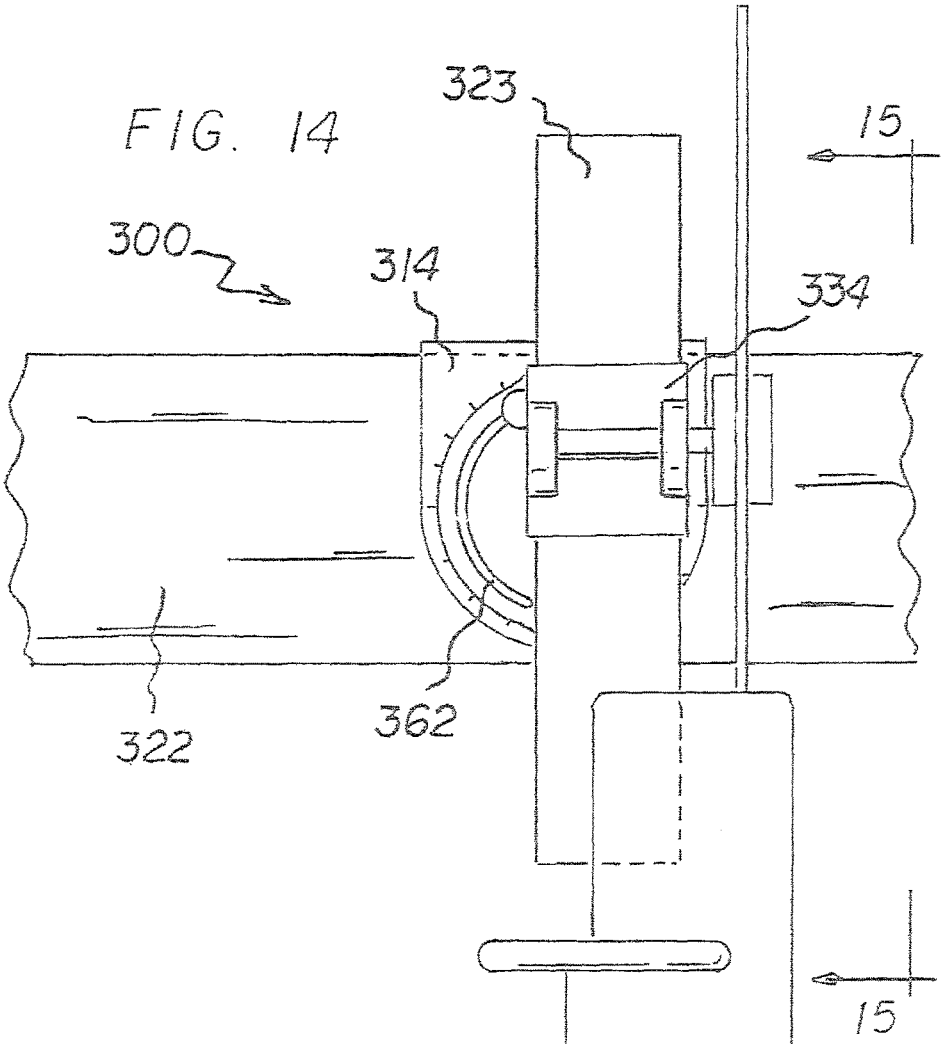
FIG. 14 is a plan view of another slotting device constructed in accordance with the principles of the present invention.
Figure 15:
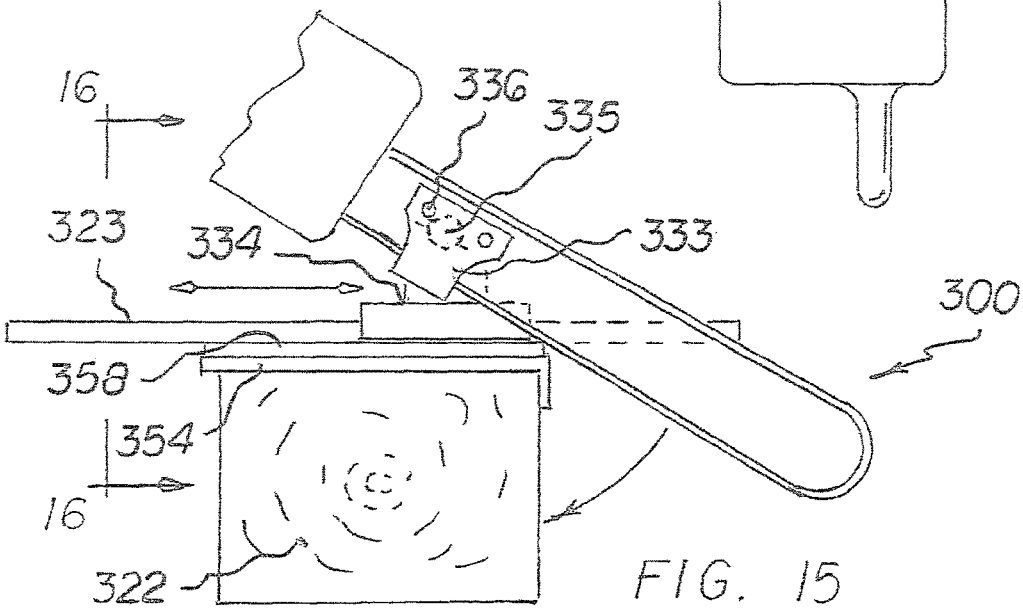
FIG. 15 is a front elevational view taken along line 15-15 of FIG. 14.
Figure 16:
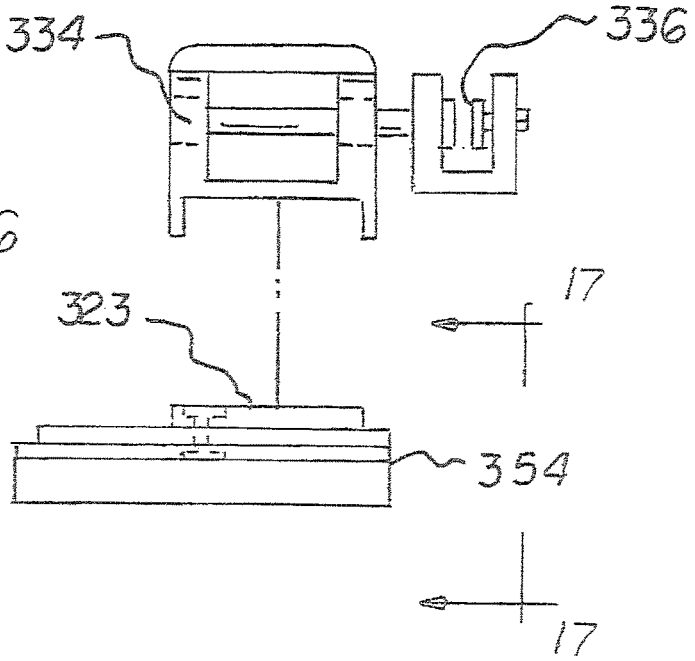
FIG. 16 is a side elevational view taken along line 16-16 of FIG. 15.
Figure 17:
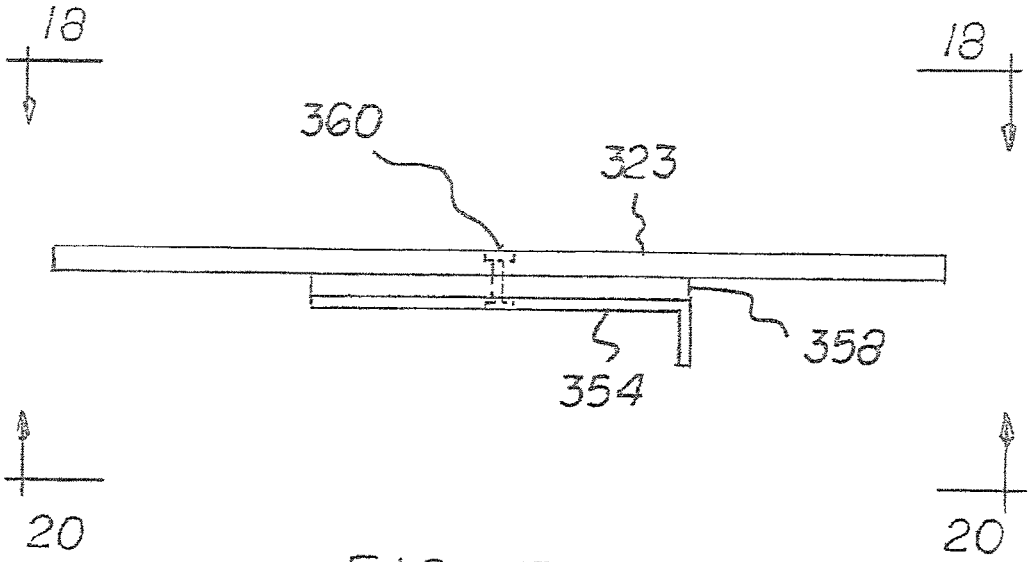
FIG. 17 is an exploded side elevational view taken along line 17-17 of FIG. 16.

FIGS. 12A, 12B, and 12C illustrate an adapter 230. The adapter is removably positioned upon an end of a workpiece to be cut. The adapter is utilized to accommodate a smaller workpiece by positioning the slotting device at an appropriate elevation for a particular application. The preferred configuration of the adapter is in an L-shaped configuration. A long leg 232 is positioned upon the upper surface of the workpiece above the slot. The preferred configuration includes a short leg 234 positioned on an end face of a workpiece above the slot.

The slotting device of the present invention is an improvement over U.S. Pat. No. 4,040,75 issued Jan. 31, 1978 to Granberg, the subject matter of which is incorporated herein by reference.

Another alternate embodiment of the invention includes a cutting guide device 300 for use with a chainsaw and a workpiece 322 having a face to be cut. The chainsaw is of the type having a motor housing portion, a substantially planar guide bar portion rigidly projecting from the motor housing portion, and a cutting chain portion surrounding a perimeter of the guide bar portion.

First provided in this cutting guide device is a rail 323 positioned adjacent to the workpiece and defining a translational axis.

Next, a carriage 334 is provided. The carriage is slidably mounted on the rail and is adapted for constrained translational movement parallel to the translational axis.

A turret 333 is next provided. The turret is attached to the carriage for translational movement therewith and is adapted for pivotal rotation relative to the carriage about a horizontal pivot axis 335 disposed normal to the vertical translational axis.

Next, a chainsaw gripper 336 is provided. The chainsaw gripper is adapted to selectively, rigidly grip the chainsaw by the guide bar portion thereof with a cutting plane defined by the guide bar being vertically oriented and normal to the horizontal pivot axis. The gripper is mounted on the turret for rotation therewith about a horizontal axis while gripping the chainsaw, between a raised position, whereat the guide bar and cutting chain portion of the chainsaw are disposed frontwardly from the face, and a lowered position, whereat the guide bar portion and cutting chain portion intersect the face in cutting relation, thereby to cut the workpiece along the cutting plane.

In this embodiment, an adjustment assembly 350 is provided. The adjustment assembly includes a base component 354 coupled to the rail and a rotatable component 358 coupled to the carriage. A vertically oriented pivot pin 360 couples the rotatable component to the base component. A plurality of threaded holes 370 in the base are equally spaced from the pivot pin. An arcuate slot 362 is provided in the rotatable component with angle indicia. A knob 366 with a threaded bolt extends downwardly through the arcuate slot into a preselected one of the plurality of threaded holes 370 in the base to secure the rotatable component to the base component at a preselected angle.

The beam slotting device of the present invention is an improvement over U.S. Pat. No. 6,192,592 issued Feb. 27, 2001 to Zimmerman, the subject matter of which is incorporated herein by reference.

Figure 23:
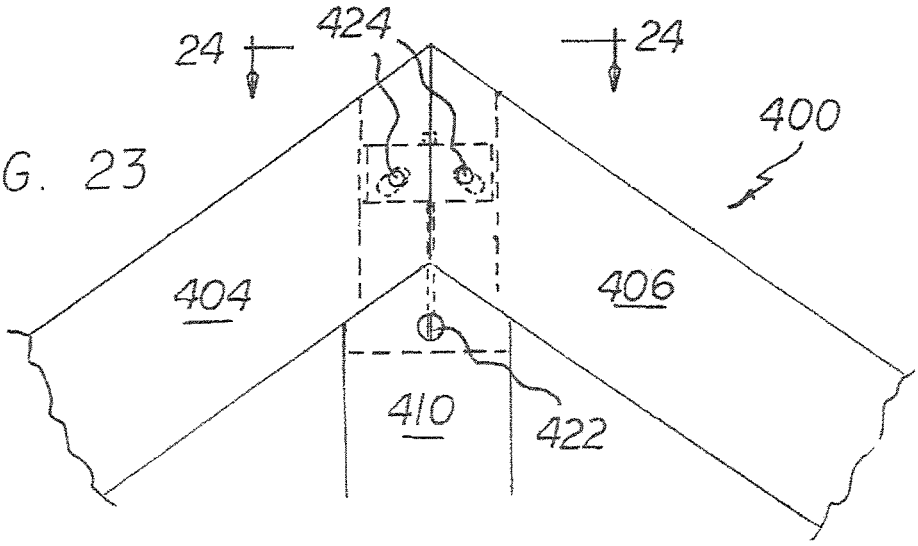
FIG. 23 is a front elevational view of an alternate embodiment for a roof constructions.
Figure 24:
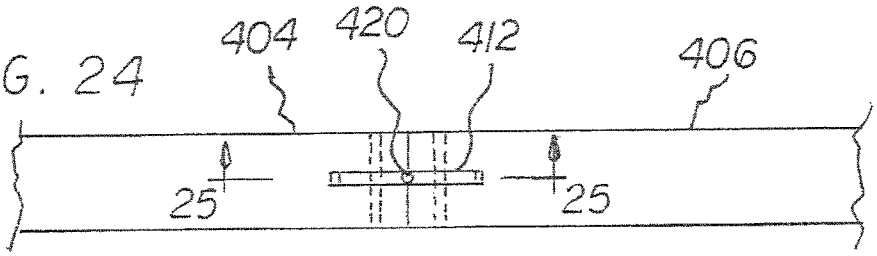
FIG. 24 is a plan view taken along line 24-24 of FIG. 23.
Figure 25:
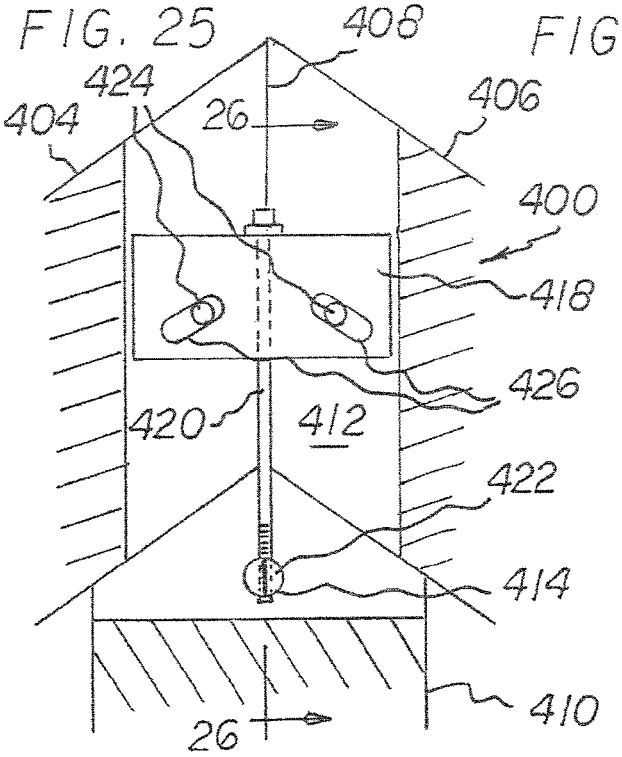
FIG. 25 is a cross sectional view taken along line 25-25 of FIG. 24.
Figure 26:
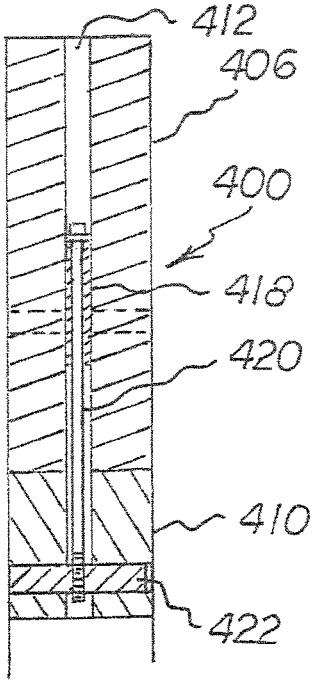
FIG. 26 is a cross sectional view taken along line 26-26 of FIG. 25.

FIGS. 23-25 illustrate a connector of an alternate construction 400. Such connector is employed for coupling adjacent first and second rafters 404, 406 supporting a roof. Rafters coupled together are usually called trusses. The first and second rafters are supported at an angle in an inverted V-shaped configuration meeting at an apex 408. The first and second rafters are supported from below by a load bearing post 410 with an inverted V-shaped upper edge in contact with the first and second rafters adjacent to the apex. A vertical slot 412 is formed in the first and second rafters extending through the apex and depending into the load bearing post. The slot includes a cylindrical enlargement 414 in the load bearing post adjacent to a lower end of the slot.

Within the slot is hardware. The hardware includes a block 418, a bolt 420, a cylinder 422, and two pins 424. The bolt has a headed end above and a threaded end below. The cylinder has an axially disposed threaded aperture receiving the threaded end of the bolt. The block has on unthreaded bore slidably receiving a central extent of the bolt. The block also has two angled slots 426 in an inverted V-shaped configuration. The two pins extend through the first and second rafters respectively. The pins are slidably received in the slots respectively whereby rotation of the head end of the bolt will lower the block moving the pins inwardly to more securely bring the rafters together at the apex. In addition, rotation of the head end of the bolt will more securely bring together the rafters and the load bearing post.

The present invention may be considered the components to be coupled and/or the couplers and/or the hardware coupling the rafters and/or the tools to accurately cut and/or drill the components to be coupled.

The present invention is a new concept that greatly simplified the construction of post and beam buildings by eliminating traditional labor-intensive methods. Various sizes are provided. The connectors match the dimensions of the timbers specified in a user's plans. Time and money is saved using provided plans and connectors and tools. The job is quicker, stronger and less expensive using the present invention. The connectors are versatile for use in cabins, studios, barns, workshops, gazebos, pergolas, car barns, deck railing, and any addition. Timber framing is made easier and faster. The designs are engineer-approved. Custom plans are available. All tooling necessary is provided.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A post and beam system comprising:

the beam having an upper face and a lower face and side faces and an end face, the end face having a rectangular configuration and being vertically disposed, the end face having a slot with an opening, the slot being vertically disposed and parallel with, and equally spaced from, the side faces, the slot having tapered edges at the opening, with the side faces interiorly of the opening being of a same width, beam holes extending through the beam on opposite sides of the slot;

the post having a front face and a parallel rear face and parallel side faces, screw holes in the front face;

a one piece connector having a first section, beam apertures formed in the first section, the first section with the beam apertures positioned in the slot with the beam apertures aligned with the beam holes, the connector having a second section attached to the post on opposite sides of the first section, the connector having a T-shaped cross sectional configuration consisting of the first section and the second section wherein the first section is in a rectangular configuration and the second section is in a rectangular configuration and intersections between the first and second sections of the connector include a fillet to either side of the first section;

screws extending through the screw holes and into the front face of the post; and cylindrical dowels extending through the beam holes and the beam apertures thereby coupling the beam to the post, wherein the tapered edges of the slot are complementary to the fillets of the connector.

2. A post and beam system for coupling a post to a beam, and for preparing the post and the beam for the coupling, the system comprising, in combination;

the beam having a rectangular cross sectional configuration with four elongated faces and an end face, the four elongated faces including a horizontally disposed upper face and a parallel lower face, the four elongated faces also including parallel vertically disposed side faces, the end face having a rectangular configuration and being vertically disposed, a slot with an opening formed in the end face parallel with and equally spaced from the side faces, the slot being vertically disposed, the slot having a same thickness throughout its extent interiorly of the opening, beam holes extending through the beam on opposite sides of the slot;

the post having a rectangular cross sectional configuration with four elongated faces and an end face, each of the four elongated faces being vertically disposed, the four elongated faces including a front face and a parallel rear face, the four elongated faces also including parallel side faces, the front face having a plurality of screw holes, the end face being vertically disposed and having a rectangular configuration, the post and the beam being fabricated of wood; and a one piece connector having a T-shaped cross sectional configuration and consisting of a vertically disposed rectangular cross component and a vertically disposed rectangular central component, the central component being attached to the cross component at a central extent of the cross component, screw holes formed in the cross component on opposite sides of the of the central component, screws extending through the screw holes and into the front face of the post, the central component having beam apertures, the slot receiving the central component with the beam apertures, with the beam apertures aligned with the beam holes, cylindrical dowels extending through the beam holes and the beam apertures thereby coupling the beam to the post, wherein the slot includes tapered edges at the opening, intersections between the vertically disposed rectangular cross component and the vertically disposed rectangular central component of the connector include a fillet to either side of the vertically disposed rectangular central component, and the tapered edges of the slot are complementary to the fillets of the connector.

3. The system as set forth in claim 1, wherein the connector is comprised of aluminum.

4. The system as set forth in claim 1, wherein the cylindrical dowels do not include fluting.

5. The system as set forth in claim 1, wherein each screw hole of the connector includes a shoulder configured to receive a head of one of the screws such that the head of each screw, when the screw is screwed into the post, is flush with a surface of the connector.

6. The system as set forth in claim 2, wherein the connector is comprised of aluminum.

7. The system as set forth in claim 2, wherein the cylindrical dowels do not include fluting.

8. The system as set forth in claim 2, wherein each screw hole of the connector includes a shoulder configured to receive a head of one of the screws such that the head of each screw, when the screw is screwed into the post, is flush with a surface of the connector.

* * * * *